US011331690B2

(12) United States Patent
Butvin

(10) Patent No.: US 11,331,690 B2
(45) Date of Patent: May 17, 2022

(54) SYSTEM, DEVICE, AND METHOD FOR REMOVING PAINT FROM MIXING PADDLES

(71) Applicant: Donald J. Butvin, Ashland, OH (US)

(72) Inventor: Donald J. Butvin, Ashland, OH (US)

( * ) Notice: Subject to any disclaimer, the term of this patent is extended or adjusted under 35 U.S.C. 154(b) by 0 days.

(21) Appl. No.: 16/918,781

(22) Filed: Jul. 1, 2020

(65) Prior Publication Data

US 2021/0094065 A1 Apr. 1, 2021

Related U.S. Application Data

(60) Provisional application No. 62/908,763, filed on Oct. 1, 2019.

(51) Int. Cl.

| | |
|---|---|
| ***B05C 17/00*** | (2006.01) |
| ***B05C 17/10*** | (2006.01) |
| ***B44D 3/10*** | (2006.01) |
| *B44D 3/16* | (2006.01) |
| *B44D 3/00* | (2006.01) |
| *B44D 3/12* | (2006.01) |

(52) U.S. Cl.

CPC ..... *B05C 17/10* (2013.01); *B44D 3/105* (2013.01); *B44D 3/00* (2013.01); *B44D 3/006* (2013.01); *B44D 3/126* (2013.01); *B44D 3/16* (2013.01); *B44D 3/164* (2013.01)

(58) Field of Classification Search

CPC . B25F 1/00; B25F 13/00; B05C 17/10; B44D 3/105; B44D 3/06; B44D 3/162; B44D 3/126; B44D 3/16; B44D 3/164; B01F 13/00; A47J 43/10; A47L 13/08; A46B 11/0093

USPC ..... 7/105, 151; 15/236.1, 220.4, 210.1

See application file for complete search history.

(56) References Cited

U.S. PATENT DOCUMENTS

| | | | | |
|---|---|---|---|---|
| D265,601 | S | 7/1982 | Olsson | |
| 4,350,445 | A | 9/1982 | Olsson | |
| 4,553,279 | A | 11/1985 | Gassew et al. | |
| 4,558,520 | A * | 12/1985 | Forde, Jr. | G01F 23/045 15/220.4 |
| 4,890,807 | A | 1/1990 | Desjardins | |
| 4,896,390 | A * | 1/1990 | Durant | B44D 3/00 366/129 |

(Continued)

FOREIGN PATENT DOCUMENTS

| | | |
|---|---|---|
| EP | 1279523 | 1/2003 |

*Primary Examiner* — Katina N. Henson

(74) *Attorney, Agent, or Firm* — Porter, Wright, Morris & Arthur, LLP

(57) ABSTRACT

A wiping device for removing fluid material from a mixing paddle. The wiping device includes a contact portion and an accumulation portion that downwardly extends from a lower end of the contact portion. A passage extends through the contact portion and the accumulation portion and is adapted for receiving the mixing paddle therethrough. An upper portion of the passage is located within the contact portion and is sized and shaped to contact opposed sides of the mixing paddle to wipe the fluid material off of the opposed sides of the mixing paddle when the contact portion is moved along the opposed sides of the mixing paddle. A lower portion of the passage located within the accumulation portion forms a cavity in fluid flow communication with the upper portion of the passage in the contact portion.

20 Claims, 6 Drawing Sheets

(56) References Cited

U.S. PATENT DOCUMENTS

| | | | | |
|---|---|---|---|---|
| 4,942,669 | A * | 7/1990 | Schnedl | G01F 23/04 33/725 |
| 4,969,617 | A | 11/1990 | Desjardins | |
| 5,084,932 | A * | 2/1992 | Zanchi | A46B 11/0093 15/168 |
| 5,765,255 | A * | 6/1998 | Bychkowsky | G01F 23/045 15/210.1 |
| 10,052,597 | B2 | 8/2018 | Van Der Kooij | |
| 2018/0206623 | A1* | 7/2018 | Welschoff | A46B 15/0048 |

* cited by examiner

SYSTEM, DEVICE, AND METHOD FOR REMOVING PAINT FROM MIXING PADDLES

CROSS-REFERENCE TO RELATED APPLICATIONS

This application claims the priority benefit of U.S. provisional patent application No. 62/908,763 filed on Oct. 1, 2019, the disclosure of which is expressly incorporated herein in its entirety by reference.

STATEMENT REGARDING FEDERALLY SPONSORED RESEARCH

Not applicable

PARTIES TO A JOINT RESEARCH AGREEMENT

Not Applicable

REFERENCE TO APPENDIX

Not applicable

FIELD OF THE INVENTION

The field of the present invention relates to handheld mixing paddles used for mixing paint, varnish, lacquer, shellac and other such viscous fluids which need to be mixed before application and, more particularly, to systems, devices, and methods for removing such fluids from the handheld mixing paddles after mixing.

BACKGROUND OF THE INVENTION

Paint and like fluids to be applied to surfaces such as, for example but not limited to, varnish, lacquer, shellac and the like is typically stored in cans or other like containers until the paint is to be applied. When paint is stored for a significant time, heavier sediments or pigments sink to the bottom of the container. As a result, the paint must be mixed or stirred before the paint can be applied. Otherwise, the paint could not be evenly applied, resulting in a poor quality finish. Additionally, when blending different colors of paint together, it is necessary to thoroughly mix the different paints together to obtain a homogenous mixture.

Wooden handheld mixing paddles or sticks have commonly been used for manually mixing and/or stirring, paint. The handheld wooden mixing paddles have the advantage that they can be produced at a very low cost. As a result, these wooden handheld mixing paddles have often been provided by paint retailers to paint purchasers at no or very little cost.

More recently, plastic handheld mixing paddles or sticks have been used for mixing and/or stirring, paint. These plastic handheld mixing paddles or sticks have the advantage that they can be more easily manufactured with more effective shapes. For example, but not limited to, through holes can be provided so that the handheld mixing paddle or stick can be more easily moved through the paint which enhances mixing and/or curvature can be provided which influences fluid flow around the handheld mixing paddle or stick so that vortices are created in the paint which enhance mixing.

The wood and plastic handheld mixing paddles or sticks can effectively mix paint within the paint can or container. However, it can be quite messy when removing the handheld mixing paddle or stick from the can or container because excess paint which sticks or adheres to the handheld mixing paddle or stick begins to drip off. The handheld mixing paddle or stick has commonly been scraped along the top rim of the paint can to remove as much paint as possible but this is not very effective because the top of the can is round and the mixing paddle or stick is either flat or of a different curvature than the can. This can also make it difficult and/or messy to re-attach the lid to the can when the rim of the can is filled with paint. Rags or towels have also been used to clean the mixing paddles or sticks but this can still be messy and is wasteful because the paint removed from the handheld mixing paddle or stick cannot be reused. As paints become more and more expensive, it is more and more important to make sure that wasted paint is minimized.

One attempt to solve these problems is a handheld mixing paddle described in U.S. Pat. No. 4,896,390, the disclosure of which is expressly incorporated herein in its entirety by reference. This handheld mixing paddle has a disposable sleeve that is placed over a paddle portion before mixing and then removed and discarded after mixing. Even if this handheld mixing paddle can effectively keep the paddle portion clean, it is still wasteful because the excess paint is discarded rather than recovered.

Another attempt to solve these problems is a handheld mixing paddle described in European Patent Number EP 1 279 523 A1, the disclosure of which is expressly incorporated herein in its entirety by reference. This handheld mixing paddle has a paddle portion that can be telescopically moved into a handle portion. As the paddle portion is telescopically moved into the handle portion, excess paint is removed from the paddle portion by a wiper surface that is included in the handle portion. Even if this mixing paddle can effectively remove and recover excess paint after use, the mixing paddle is complicated and relatively expensive to manufacture. Thus, such handheld mixing paddles are not economically viable for single use and/or for free give-away by paint retailers.

Yet another attempt to solve this problem is a handheld mixing paddle described in U.S. Pat. No. 10,052,597, the disclosure of which is expressly incorporated herein in its entirety by reference. This handheld mixing paddle has a detachable end portion that can be used as a scraper to scrape off excess paint from the remainder of the handheld mixing paddle. Again, even if this handheld mixing paddle can effectively remove and recover excess paint after use, the mixing paddle is complicated and relatively expensive to manufacture. Thus, such handheld mixing paddles are not economically viable for single use and/or for free give-away by paint retailers.

Accordingly, there exists a need for improved systems, devices, and methods for removing fluid material from handheld mixing paddles that reduce mess and/or waste in a cost effective manner.

SUMMARY OF THE INVENTION

The present invention provides systems, devices, and methods which address at least one of the above-noted problems of the prior art. Disclosed herein is a wiping device for removing fluid material from a mixing paddle having opposed sides. The wiping device comprises, in combination a contact portion and an accumulation portion downwardly extending from a lower end of the contact portion. A passage extends through the contact portion and the accumulation portion and is adapted for receiving the mixing paddle therethrough. An upper portion of the passage is located within the contact portion is sized and shaped to contact the opposed sides of the mixing paddle to wipe the fluid material off of the opposed sides of the mixing paddle when the contact portion is moved along the opposed sides of the mixing paddle. A lower portion of the passage is located within the accumulation portion forms a cavity in fluid flow communication with the upper portion of the passage in the contact portion The cavity is adapted to receive the fluid material wiped from the opposed sides of the mixing paddle by the contact portion.

Also disclosed a system for mixing a fluid material comprising, in combination a mixing paddle having opposed sides and a wiping device having a contact portion and an accumulation portion downwardly extending from a lower end of the contact portion. A passage extends through the contact portion and the accumulation portion and is adapted for receiving the mixing paddle therethrough. An upper portion of the passage is located within the contact portion is sized and shaped to contact the opposed sides of the mixing paddle to wipe fluid material off of the opposed sides of the mixing paddle when the contact portion is moved along the opposed sides of the mixing paddle. A lower portion of the passage is located within the accumulation portion forms a cavity in fluid flow communication with the upper portion of the passage in the contact portion. The cavity is adapted to receive the fluid material wiped from the opposed sides of the mixing paddle by the contact portion.

Further disclosed is a method for removing fluid material from a mixing paddle having opposed sides. The method comprises, in combination, the steps of: obtaining a wiping device having a contact portion and an accumulation portion downwardly extending from a lower end of the contact portion. A passage extends through the contact portion and the accumulation portion and is adapted for receiving the mixing paddle therethrough. An upper portion of the passage located within the contact portion is sized and shaped to contact the opposed sides of the mixing paddle to wipe the fluid material off of the opposed sides of the mixing paddle when the contact portion is moved along the opposed sides of the mixing paddle. A lower portion of the passage is located within the accumulation portion forms a cavity in fluid flow communication with the upper portion of the passage in the contact portion. The cavity is adapted to receive the fluid material wiped from the opposed sides of the mixing paddle by the contact portion. The steps of inserting the mixing paddle into the passage of the wiping device so that the mixing paddle extends through the passage, mixing fluid material with mixing paddle, and moving the wiping device downward along the mixing paddle to wipe the fluid material from the opposed sides and into the accumulation portion.

From the foregoing disclosure and the following more detailed description of various preferred embodiments it will be apparent to those skilled in the art that the present invention provides a significant advance in the technology and art of handheld mixing paddles. Particularly, significant in this regard is the potential the invention affords for providing reliable, inexpensive, and effective handheld wiping devices that wipe excess material from the handheld mixing paddles so that both the handheld mixing paddles and excess material being mixed can be recovered and reused. Additional features and advantages of the invention will be better understood in view of the detailed description provided below.

BRIEF DESCRIPTION OF THE DRAWINGS

These and further objects of the invention will become apparent from the following detailed description.

Figure 1:
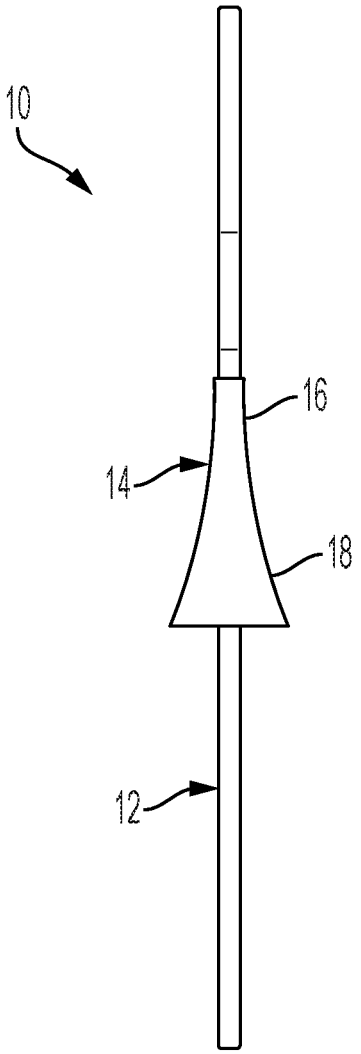
FIG. 1 is a right-side elevational view of a handheld mixing paddle with a handheld wiping device thereon according to a first embodiment of the present invention.

It should be understood that the appended drawings are not necessarily to scale, presenting a somewhat simplified representation of various preferred features illustrative of the basic principles of the invention. The specific design features of the various handheld mixing paddles and handheld wiping devices as disclosed herein, including, for example, specific dimensions, orientations, locations, and shapes will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the structures illustrated in the drawings. In general, up or upward generally refers to an upward direction within the plane of the page in FIG. 1 and down or downward generally refers to a downward direction within the plane of the page in FIG. 1. Also in general, fore or forward generally refers to a leftward direction within the plane of the page in FIG. 1 and aft or rearward generally refers to an rightward direction within the plane of the page in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the systems, devices, methods disclosed herein. The following detailed discussion of various alternative and preferred embodiments will illustrate the general principles of the invention with regard to the specific application of handheld mixing paddles for gallon-size storage cans or containers. Other embodiments suitable for other applications will be apparent to those skilled in the art given the benefit of this disclosure.

Figure 2:
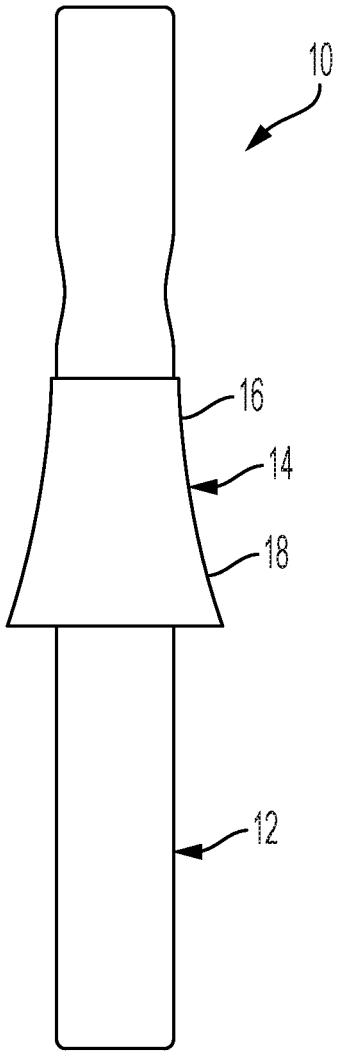
FIG. 2 is a front elevational view of the handheld mixing paddle and the handheld wiping device of FIG. 1.
Figure 3:
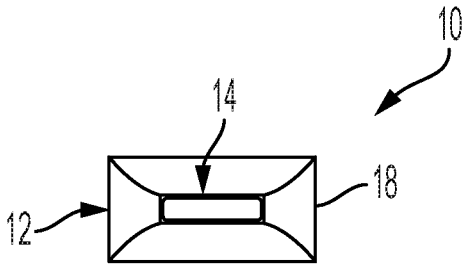
FIG. 3 is a bottom plan view of the handheld mixing paddle and the handheld wiping device of FIGS. 1 and 2.
Figure 4:
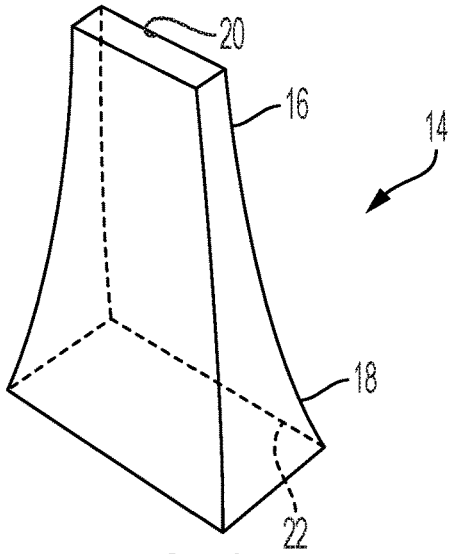
FIG. 4 is perspective view of the handheld wiping device of FIGS. 1 to 3.
Figure 5:
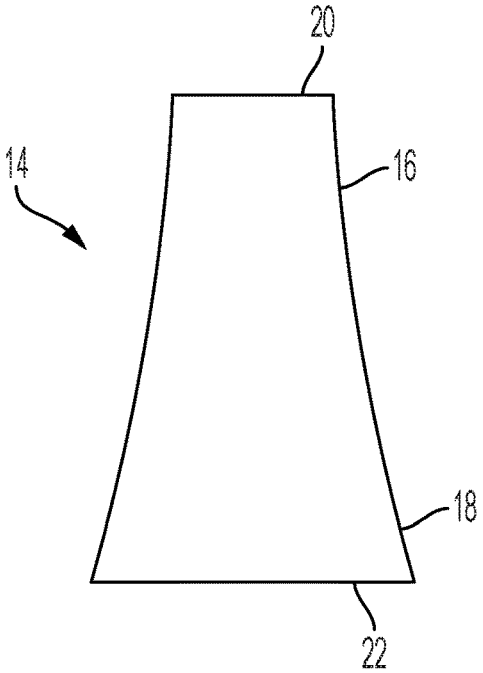
FIG. 5 is a front elevational view of the handheld wiping device of FIG. 4.
Figure 6:
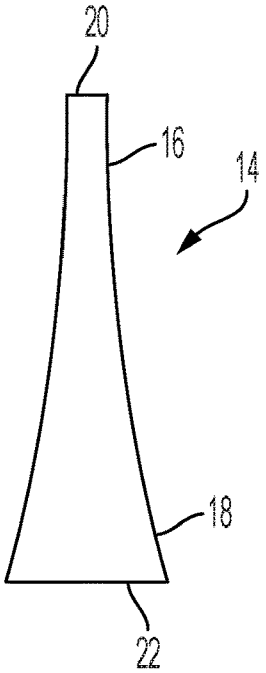
FIG. 6 is left-side elevational view of the handheld wiping device of FIGS. 4 and 5.
Figure 7:
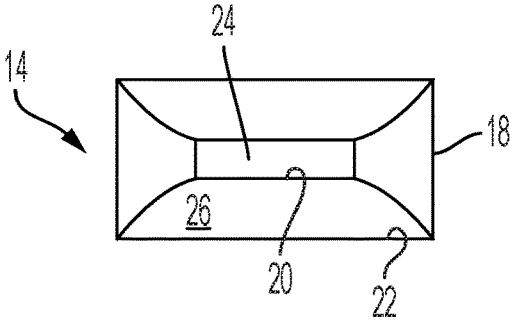
FIG. 7 is a bottom plan view of the handheld wiping device of FIGS. 4 to 6.
Figure 8:
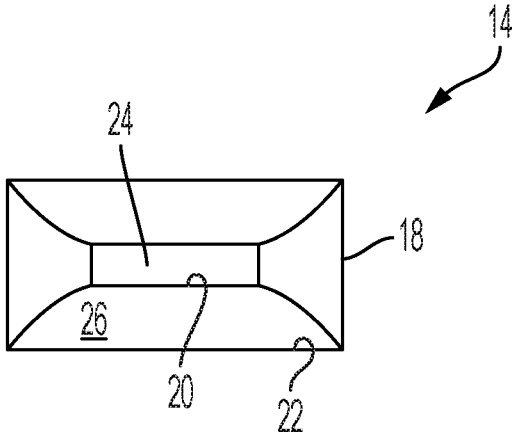
FIG. 8 is top plan view of the handheld wiping device of FIGS. 4 to 7.
Figure 9:
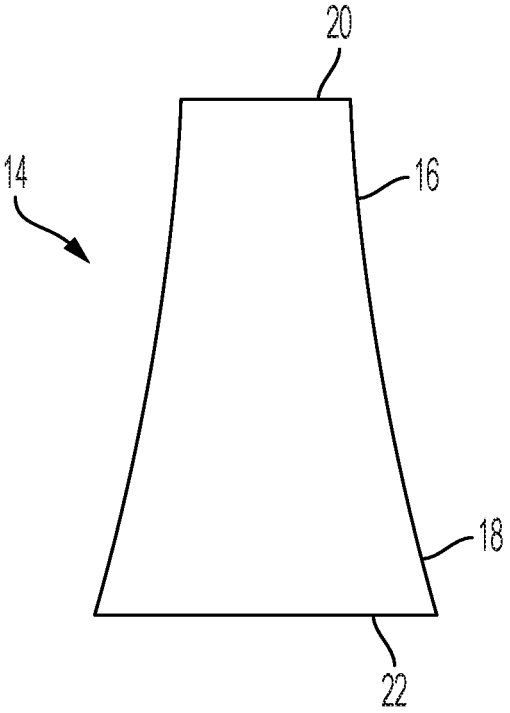
FIG. 9 is a rear elevational view of the handheld wiping device of FIGS. 4 to 8.
Figure 10:
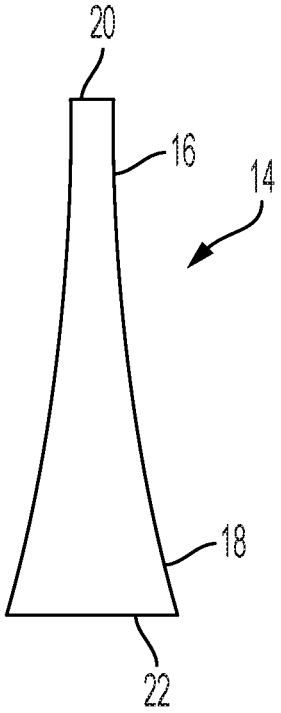
FIG. 10 is a right side elevational view of the handheld wiping device of FIGS. 4 to 9.

FIGS. 1 to 3 illustrate a fluid material mixing system 10 according to the present invention. The illustrated fluid material mixing system 10 includes a handheld mixing stick or paddle 12 for mixing fluid materials before use and a handheld wiping device 14 for removing excess fluid material from the handheld mixing paddle 12. The term "fluid material" is used in this specification and in the claims to mean paint, varnish, lacquer, shellac and other such viscous fluids which need to be stirred and/or mixed to blend components that may have separated before applying to a surface to ensure intended color and consistency on the surface.

FIGS. 4 to 10 illustrate the handheld wiping device 14. The illustrated handheld wiping device 14 includes an upper or contact portion 16 for wiping fluid material off of the handheld mixing paddle 12 and a lower or accumulation portion 18 for receiving excess fluid material that has been wiped from the hand held mixing paddle 12 by the upper portion 16 of the handheld wiping device 14. The upper portion 16 is located above the lower portion 18. As the user manually moves the handheld wiping device 14 downward along the handheld mixing paddle 12, the upper portion 16 scrapes or wipes the excess fluid from the mixing paddle 12 and the removed excess fluid material accumulates within the lower portion 18 as described in more detail below.

The illustrated handheld wiping device 14 has top and bottom openings 20, 22 with passage 24 a vertically-extending therebetween which receives the handheld mixing paddle 12 therein so that the handheld mixing paddle 12 can extend entirely through the handheld wiping device 14. The illustrated passage 24 continuously extends through the upper or contact portion 16 of the handheld wiping device 14 and the lower or accumulating portion 18 of the handheld wiping device 14.

The top opening 20 of the passage 24 is substantially rectangular shaped to closely match the cross-sectional shape of the mixing portion 42 of the illustrated hand held mixing paddle 12. It is noted that the top opening 20 can alternatively have any other suitable shape to closely match the cross-sectional shape of the mixing portion 42 of other handheld mixing paddles 12. The illustrated upper portion 16 is also substantially rectangular shaped to closely match the cross-sectional shape of the illustrated handheld mixing paddle 12. However, the sides (front, rear, left and right) of the upper portion 16 of the handheld wiping device 14 expand outwardly in the downward direction but are sized to relatively close match the sides 28, 30, 36, 38 of the mixing portion 42 of the illustrated hand held mixing paddle 12. That is, the top portion of the passage 24 is sized so that the handheld wiping device 14 can be slid along the length of the handheld mixing paddle 12 and the gap formed between the upper portion 16 of the handheld wiping device 14 and the handheld mixing paddle 12 is small enough to be closed by the user compressing the opposed front and rear sides of the upper portion 16 of the handheld wiping device 14 against the front and rear sides 28, 30 of the handheld mixing paddle 12 as described in more detail hereinbelow. The length of the upper portion 16 of the handheld wiping device 14 is sized to permit a user to grasp the front and rear sides of the upper portion 16 to move the wiping device 14 downward along the opposed front and rear sides 28, 30 of the handheld mixing paddle 12. It is noted that the upper portion 16 of the handheld wiping device 14 can alternatively have any other suitable configuration.

The illustrated lower or accumulation portion 18 of the handheld wiping device 14 downwardly extends from the lower end of the upper or contact portion 16 of the handheld wiping device 14. The passage 24 forms an interior cavity or space 26 within the lower portion 18 of the handheld wiping device 14 that is in fluid flow communication with the lower end of the passage 24 in the upper portion 16 and is adapted to receive the excess fluid material scraped or wiped from the opposed sides 28, 30 of the handheld mixing paddle 12 by the upper portion 16 of the handheld wiping device 14. The bottom opening 22 of the passage 24 is open at the bottom end of the lower portion 18 and substantially larger than the bottom of the handheld mixing paddle 12 so that wiped-off fluid material can accumulate within the cavity 26 during wiping and then later can flow down and out of the handheld wiping device 14 and into the storage can or container, or other desired location. The illustrated lower portion 18 of the handheld wiping device 14 also expands or enlarges in the downward direction like the upper portion 16 but at a greater rate. That is, the bottom opening 22 of the passage 24 is substantially larger than the top opening 20 of the passage 24 because the passage 24 forms the cavity 26 within the lower portion 18. Thus, a gap formed between the lower portion 18 of the handheld wiping device 14 and the handheld mixing paddle 12 is substantially larger, particularly at the bottom opening 22, than the gap formed between the upper portion 16 of the handheld wiping device 14 and the handheld mixing paddle 12. The illustrated lower portion 18 of the handheld wiping device 14 is substantially rectangular shaped at its top and bottom ends with the bottom end having a larger size than the top end. Between the top and bottom ends, the walls gradually expand so that each of the four walls are curved and curve outwardly in a downward direction. It is also noted that any other suitable shape can alternatively be utilized such as, for example but not limited to, circular, oval, other polygons, and the like. It is noted that the lower portion 18 of the handheld wiping device 14 can alternatively have any other suitable configuration.

The illustrated wiping device 14 is manufactured as a unitary one-piece component formed by folding a flat sheet of one material but can alternatively have any other suitable configuration such as, for example but not limited to, two or more components of a single material secured together, two or more components of different materials secured together, a single molded component of one or more materials, and the like. The upper or contact portion 16 of the handheld wiping device 14 is preferably formed of an at least somewhat flexible or resiliently deformable material so that the upper portion 16 can be squeezed by the user into contact with the opposed sides 28, 30 of the handheld mixing paddle 12 while sliding the handheld wiping device 14 down the handheld mixing paddle 12. This enables the passage 24 in the upper portion 16 of the handheld wiping device 14 to be sized as a clearance opening with the handheld mixing paddle 12 so that it is easier to install and remove the handheld wiping device 14 onto and from the handheld mixing paddle 12. Alternatively, the upper portion 16 of the handheld wiping device 14 can be formed of a non-flexible or non-deformable material with at least a portion of the passage 24 within the upper portion 16 sized as an interference or near interference fit with the handheld mixing paddle 12 so that at least a portion of the upper portion 16 of the handheld wiping device 14 is in contact with the handheld mixing paddle 12 to scrape or wipe off excess fluid material. The lower portion 18 of the handheld wiping device 14 is also preferably formed of an at least somewhat flexible or resiliently deformable material so that the lower portion 18 of the handheld wiping device 14 can be squeezed by the user in order to squeeze out the removed fluid material that is located in the cavity 24 to return it back into the storage can or container. Alternatively, the lower portion 18 of the handheld wiping device 14 can be formed of a non-flexible or non-deformable material and the removed fluid material therein can be returned back into the storage can or container by shaking, tapping, and the like. It is noted that the upper and lower portions 16, 18 of the handheld wiping device 14 can be formed of the same or different materials. The handheld wiping device 14 is also preferably formed with a low-cost disposable material such as, for example but not limited to, paper, plastic and the like. If desired, paper can be coated with a plastic material on one or both sides of the paper to prevent absorption of the fluid material. Alternatively, the handheld wiping device 14 can be formed of a material suitable for multi-time use such as, for example but not limited to, wood, plastic, metal, and the like.

Figure 11:
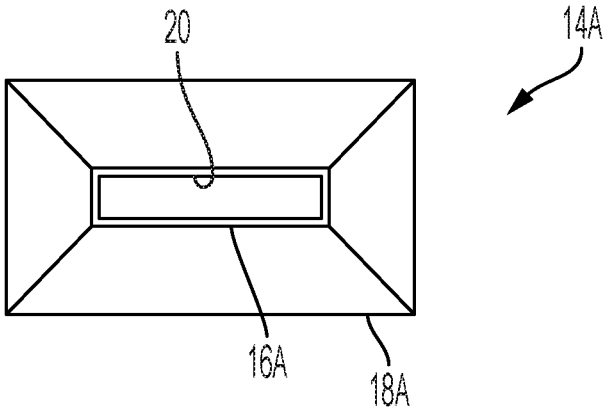
FIG. 11 is top plan view of a handheld wiping device according to a second embodiment of the invention, wherein the bottom view is the same.
Figure 12:
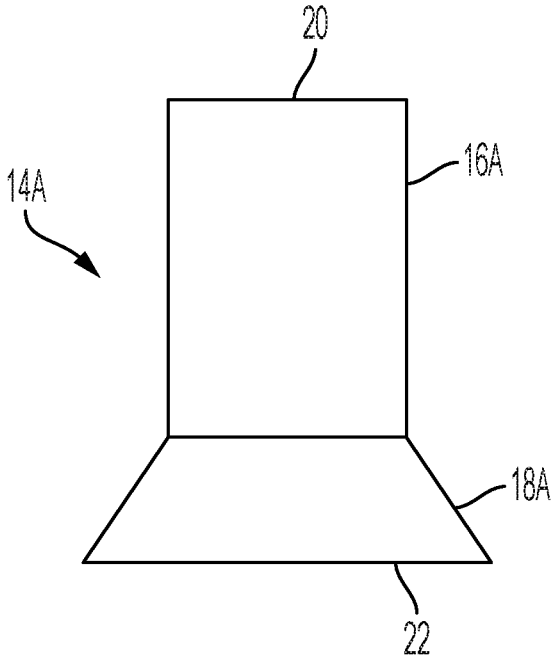
FIG. 12 is a front elevational view of the handheld wiping device of FIG. 11, wherein the rear view is the same.
Figure 13:
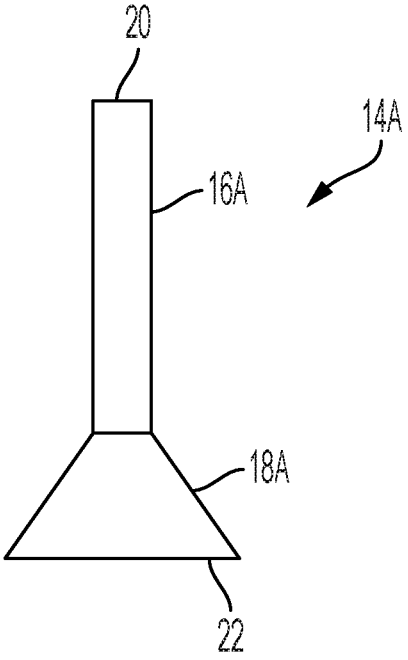
FIG. 13 is a left side elevational view of the handheld wiping device of FIGS. 11 and 12, wherein the right-side view is the same.
Figure 14:
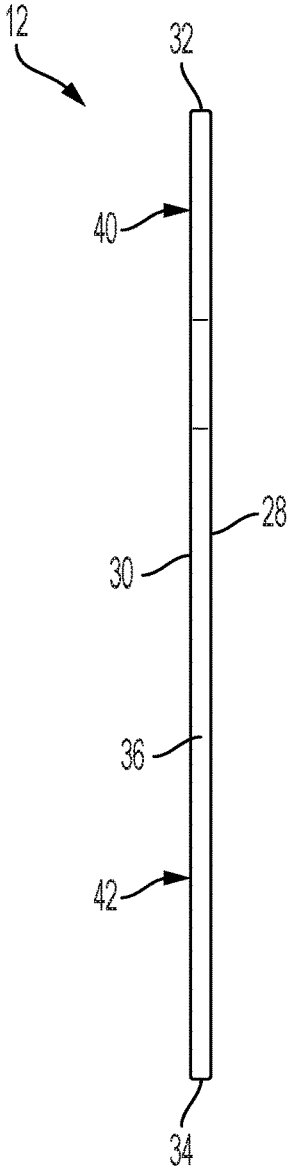
FIG. 14 is a right-side elevational view of the handheld mixing stick of FIGS. 1 to 3, wherein the left-side view is the same.
Figure 15:
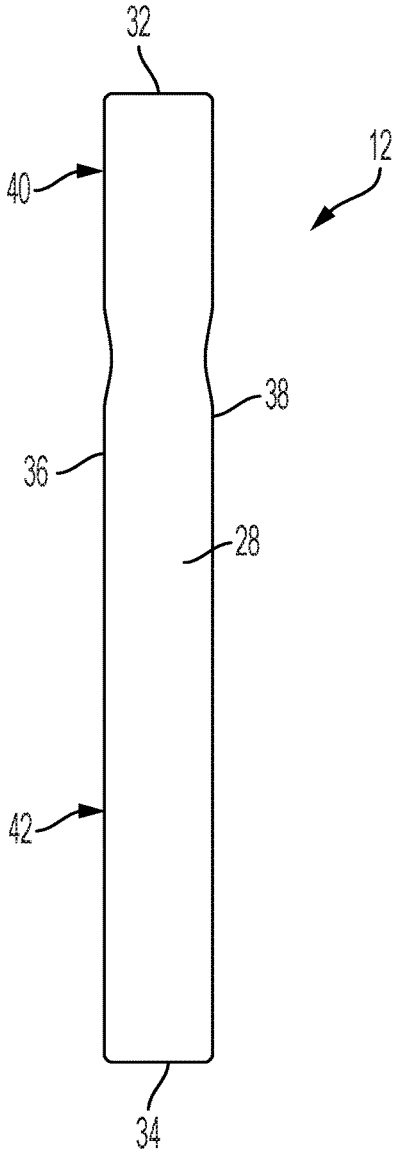
FIG. 15 is a front elevational view of the handheld mixing stick of FIG. 14, wherein the rear view is the same.
Figure 16:
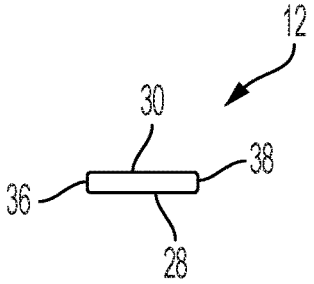
FIG. 16 is a top plan view of the handheld mixing stick of FIGS. 14 and 15.
Figure 17:
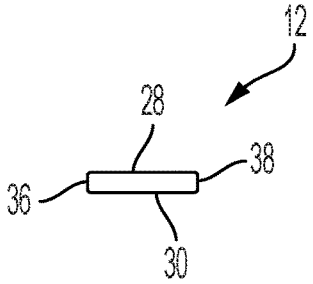
FIG. 17 is a bottom plan view of the handheld mixing stick of FIGS. 14 to 16.

FIGS. 11 to 13 illustrate a handheld wiping device 14A according to a second embodiment of the invention. The handheld wiping device 14A of the second embodiment is substantially the same as the handheld wiping device 14 of the first embodiment except for the shape of the upper and lower portions 16A, 18A of the handheld wiping device 14A. Instead of expanding outward in the downward direction like in the first embodiment, the upper portion 16A does not expand outward in the downward direction. Thus, the gap between the upper portion 16A of the hand held wiping device 14A and the handheld mixing paddle 12 remains substantially constant and relatively small so that less deformation is required than in the first embodiment. Instead of expanding in the downward direction at an increasing rate like in the first embodiment, the lower portion 18A of the handheld wiping device 14A expands in a constant rate. Thus, each of the four walls are planar and angle outwardly in a downward direction rather than with a curve like in the first embodiment. The handheld wiping device 14A of the second embodiment illustrates that the upper and lower portions 16A, 18A can have any suitable shape.

As best shown in FIGS. 14 to 17, the illustrated handheld mixing stick or paddle 12 is generally elongate having elongate and flat front and rear sides 28, 30, flat top and bottom sides or edges 32, 34 connecting the front and rear sides 28, 30, and flat right and left sides or edges 36, 38 connecting the front and rear sides 28, 30. The illustrated left and right edges 36, 38 are provided with notches which separate an upper or handle portion 40 and a lower or mixing portion 42 of the handheld mixing paddle 12. It is noted that the handheld mixing paddle 12 can alternatively have any other suitable configuration such as, for example but not limited to, curved sides, through openings and the like.

The illustrated handheld mixing paddle 12 comprises wood. It is noted, however, that handheld mixing paddle 12 can alternatively comprise any other suitable material such as, for example but not limited to, plastic. metal, and the like.

The illustrated handheld mixing paddle 12 is sized for use with a one-gallon can or container of fluid material and has a length of about 10 inches to about 14 inches, a width of about 1 inch to about 1¼ inches, and a thickness of about 1/16 inch to about ¼ inch. It is noted that the handheld mixing paddle 12 can alternatively have any other suitable size. The illustrated handheld wiping device 14 which is sized for use with the illustrated handheld mixing paddle 12 has a top opening 20 of about 1 inch by about ¼ inch, a bottom opening 22 of about 2 inches by 1 inch, and a height of about 3 inches. It is noted that the handheld wiping device 14 can alternatively have any other suitable size.

Figure 18:
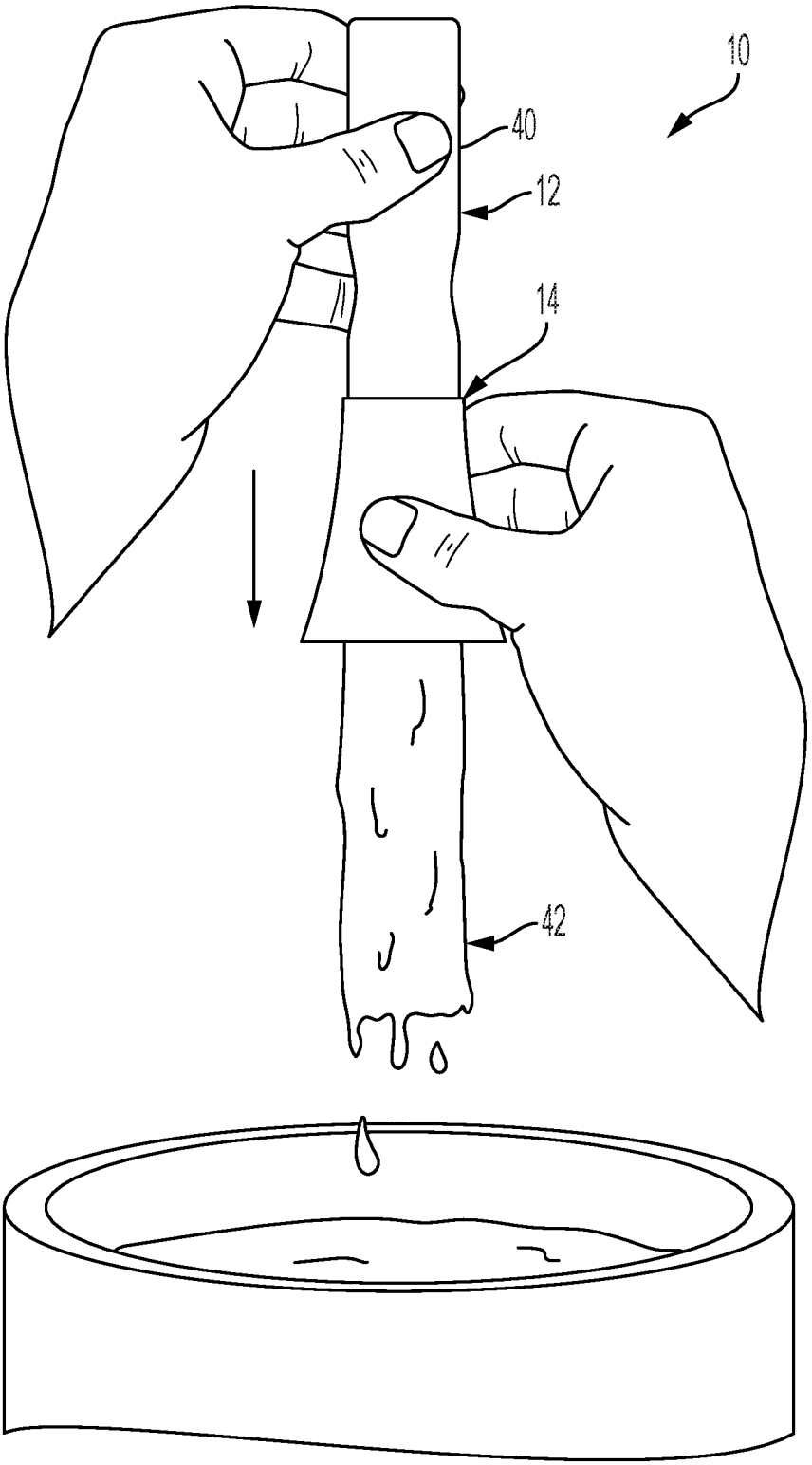
FIG. 18 is a diagrammatic view of fluid material being removed from the handheld mixing stick of FIGS. 14 to 17 with the handheld wiping device of FIGS. 4 to 10.

In use, the user initially places the handheld wiping device 14 onto the handheld mixing paddle 12 at or near the top of the mixing portion 42 of the handheld mixing paddle 12 and mixes the fluid material within a storage can or container as needed with the handheld mixing paddle 12. Alternatively, the user mixes the fluid material within a storage can or container as needed with the handheld mixing paddle 12 and then places the handheld wiping device 14 onto the handheld mixing paddle 12 at or near the top of the mixing portion 42 of the handheld mixing paddle 12. When the user desires to remove the handheld mixing paddle 12 from the fluid material, the user lifts the handheld mixing paddle 12 over the storage can or container with one hand and grasps and squeezes the sides of the upper or contact portion 16 of the handheld wiping device 14 with the other hand so that the upper or contact portion 16 is engaging both of the front and rear sides 28, 30 of the handheld mixing paddle 12 (best shown in FIG. 18). The user then downwardly pushes or moves the handheld wiping device 14 along mixing portion 42 of the handheld mixing paddle 12 while continuing to squeeze the upper portion 16 to scrape or wipe excess fluid material off of the opposed front and rear sides 28, 30 of the handheld mixing paddle 12 so that the excess fluid material accumulates in the cavity 26 at the lower end of the passage 24 within the lower or accumulation portion 18 of the handheld wiping device 14. With the handheld wiping device 14 still over the storage can or container, the user can then squeeze the lower or accumulation portion 18, and/or tap and shake the lower or accumulation portion 18, so that fluid material within the lower or accumulation portion 18 is removed and returned to the storage can or container. The handheld mixing paddle 12 and the handheld wiping device 14 can then be discarded or cleaned for later use as desired.

It is noted that each of the features of the various disclosed embodiments of the present invention can be utilized in any combination with each of the other disclosed embodiments of the present invention.

From the above disclosure it can be appreciated that the mixing paddles and wiper devices according to the present invention can provide improvements in both paint mess and reduced paint loss. It can also be appreciated that these improvements can be provided with little cost increase.

The preferred embodiments of this invention can be achieved by many techniques and methods known to persons who are skilled in this field. To those skilled and knowledgeable in the arts to which the present invention pertains, many widely differing embodiments will be suggested by the foregoing without departing from the intent and scope of the present invention. The descriptions and disclosures herein are intended solely for purposes of illustration and should not be construed as limiting the scope of the present invention.

What is claimed is:

1. A system for mixing paint by a user, said system comprising, in combination:

a hand-held mixing paddle having a handle portion, a mixing portion, and opposed flat sides continuously extending along an entire length of the hand-held mixing paddle and forming a constant thickness along the entire length of the hand-held mixing paddle;

a hand-held wiping device having a contact portion and an accumulation portion downwardly extending from a lower end of the contact portion, wherein a lower end of the accumulation portion forms a lower end of the hand-held wiping device;

wherein a passage continuously extends entirely through both the contact portion and the accumulation portion so that the passage extends entirely through the hand-held wiping device;

wherein a gap is located between both the contact portion and the accumulation portion of the hand-held wiping device and the opposed flat sides of the hand-held mixing paddle along the entire length of the passage when the hand-held mixing paddle extends entirely through the hand-held wiping device and the gap is at least partially closed within the contact portion of the hand-held wiping device when the contact portion of the hand-held wiping device is squeezed together by the user against both of the opposed flat sides of the hand-held mixing paddle to contact the opposed flat sides of the hand-held mixing paddle so that the paint is wiped off of the opposed flat sides of the hand-held mixing paddle when the contact portion is squeezed and moved along the opposed flat sides of the hand-held mixing paddle;

wherein the passage expands from an upper end of the accumulation portion to a lower end of the accumulation portion so that the gap in a lower portion of the passage located within the accumulation portion of the hand-held wiping device is larger than the gap in an upper portion of the passage located within the contact portion of the hand-held wiping device to form a cavity in fluid flow communication with the upper portion of the passage in the contact portion of the hand-held wiping device; and wherein the cavity within the accumulation portion is adapted to substantially accumulate and hold the paint wiped from the opposed flat sides of the hand-held mixing paddle by the contact portion of the hand-held wiping device as the contact portion of the hand-held wiping device is squeezed and moved along the opposed flat sides of the hand-held mixing paddle and after the hand-held mixing paddle has moved past the upper end of the accumulation portion.

2. The system according to claim 1, wherein the contact portion of the hand-held wiping device comprises paper.

3. The system according to claim 2, wherein the contact portion and the accumulation portion of the hand-held wiping device each comprise the paper.

4. The system according to claim 3 wherein the paper is coated to reduce absorbency of the paper.

5. The system according to claim 1, wherein at least the contact portion of the hand-held wiping device comprises a flexible material so that the contact portion of the hand-held wiping device can be squeezed into contact with the opposed flat sides of the hand-held mixing paddle.

6. The system according to claim 5, wherein the contact portion and the accumulation portion of the hand-held wiping device each comprise the flexible material so that the accumulation portion of the hand-held wiping device can be squeezed to remove the paint from the cavity.

7. The system according to claim 1, wherein a rectangular-shaped bottom end of the passage at the accumulation portion of the hand-held wiping device is larger than a rectangular shaped top end of the passage at the contact portion of the hand-held wiping device.

8. The system according to claim 1, wherein the passage within the accumulation portion of the hand-held wiping device expands at a constant rate.

9. The system according to claim 1, wherein the passage within both the contact portion and the accumulation portion of the hand-held wiping device gradually expands so that the passage within the hand-held wiping device curves outwardly in a downward direction.

10. The system according to claim 1, wherein the hand-held mixing paddle is formed of one of wood, plastic, and metal.

11. The system according to claim 1, wherein the hand-held mixing paddle is sized and shaped to move entirely through the passage of the hand-held wiping device.

12. The system according to claim 1, wherein the hand-held mixing paddle is portable.

13. The system according to claim 1, wherein the lower end of the hand-held wiping device is open and unconnected.

14. A system for mixing paint by a user, said system comprising, in combination:

a hand-held mixing paddle having a handle portion, a mixing portion, and opposed flat sides continuously extending along an entire length of the hand-held mixing paddle and forming a constant thickness along the entire length of the hand-held mixing paddle;

a hand-held wiping device formed of folded paper and having a contact portion and an accumulation portion downwardly extending from a lower end of the contact portion, wherein a lower end of the accumulation portion forms a lower end of the hand-held wiping device;

wherein a passage continuously extends entirely through both the contact portion and the accumulation portion so that the passage extends entirely through the hand-held wiping device;

wherein a gap is located between both the contact portion and the accumulation portion of the hand-held wiping device and the opposed flat sides of the hand-held mixing paddle along the entire length of the passage when the hand-held mixing paddle extends entirely through the hand-held wiping device and the gap is at least partially closed within the contact portion of the hand-held wiping device when the contact portion of the hand-held wiping device is squeezed together by the user against both of the opposed flat sides of the hand-held mixing paddle to contact the opposed flat sides of the hand-held mixing paddle so that the paint is wiped off of the opposed flat sides of the hand-held mixing paddle when the contact portion is squeezed and moved along the opposed flat sides of the hand-held mixing paddle;

wherein the passage expands from an upper end of the accumulation portion to a lower end of the accumulation portion so that the gap in a lower portion of the passage located within the accumulation portion of the hand-held wiping device is larger than the gap in an upper portion of the passage located within the contact portion of the hand-held wiping device to form a cavity in fluid flow communication with the upper portion of the passage in the contact portion of the hand-held wiping device; and wherein the cavity within the accumulation portion is adapted to substantially accumulate and hold the paint wiped from the opposed flat sides of the hand-held mixing paddle by the contact portion of the hand-held wiping device as the contact portion of the hand-held wiping device is squeezed and moved along the opposed flat sides of the hand-held mixing paddle and after the hand-held mixing paddle has moved past the upper end of the accumulation portion.

15. The system according to claim 14 wherein the paper is coated to reduce absorbency of the paper.

16. The system according to claim 14, wherein a rectangular-shaped bottom end of the passage at the accumulation portion of the hand-held wiping device is larger than a rectangular shaped top end of the passage at the contact portion of the hand-held wiping device.

17. The system according to claim 14, wherein the hand-held mixing paddle is formed of one of wood, plastic, and metal.

18. The system according to claim 14, wherein the hand-held mixing paddle is sized and shaped to move entirely through the passage of the hand-held wiping device.

19. The system according to claim 14, wherein the hand-held mixing paddle is portable.

20. The system according to claim 14, wherein the lower end of the hand-held wiping device is open and unconnected.

* * * * *